US007284963B1

(12) United States Patent
Houle

(10) Patent No.: US 7,284,963 B1
(45) Date of Patent: Oct. 23, 2007

(54) ZERO MAINTENANCE PUMP

(76) Inventor: Rejean Houle, 670 Coral St., Tulare, CA (US) 93274

( * ) Notice: Subject to any disclaimer, the term of this patent is extended or adjusted under 35 U.S.C. 154(b) by 629 days.

(21) Appl. No.: 10/754,873

(22) Filed: Jan. 9, 2004

(51) Int. Cl.
*F04B 43/12* (2006.01)

(52) U.S. Cl. ..... 417/53; 417/423.9

(58) Field of Classification Search ..... 417/423.1, 417/312, 423.9, 313, 53, 423.11, 423.6, 424.1; 261/29, 92, 120; 210/219, 242.2
See application file for complete search history.

(56) References Cited

U.S. PATENT DOCUMENTS

| | | | | |
|---|---|---|---|---|
| 2,459,097 | A * | 1/1949 | Rudd et al. | 417/424.1 |
| 3,322,410 | A | 5/1967 | Ahlenius | 261/92 |
| 3,510,111 | A | 5/1970 | Hochmuth | 261/29 |
| 3,595,538 | A | 7/1971 | Baumann | 261/92 |
| 3,733,787 | A | 5/1973 | Winningham | 55/228 |
| 3,807,708 | A | 4/1974 | Jones | 261/29 |
| 3,840,457 | A | 10/1974 | Wilson | 210/14 |
| 3,935,156 | A | 1/1976 | Richter | 261/37 |
| 5,006,282 | A | 4/1991 | Butcher | 261/29 |
| 5,249,930 | A * | 10/1993 | Pacquesi | 417/313 |
| 5,567,127 | A * | 10/1996 | Wentz | 417/312 |
| 6,209,495 | B1 * | 4/2001 | Warren | 123/55.2 |
| 6,325,842 | B1 | 12/2001 | Caldwell et al. | |
| 6,398,521 | B1 * | 6/2002 | Yorulmazoglu | 417/360 |
| 6,443,715 | B1 * | 9/2002 | Mayleben et al. | 417/423.1 |
| 6,746,219 | B1 * | 6/2004 | Chen | 417/424.1 |

* cited by examiner

*Primary Examiner*—Anthony Stashick
*Assistant Examiner*—Vikansha Dwivedi
(74) *Attorney, Agent, or Firm*—Sierra Patent Group, Ltd.

(57) ABSTRACT

A zero maintenance pump includes a motor having a motor housing and a motor drive shaft rotatably mounted in the motor housing. A shaft extension is coupled to the motor drive shaft distal from the motor housing. A coupling element has a body with a first end and a second end opposite the first end. The body includes a body wall defining an interior and an exterior. At least one slot is formed in the body wall. The coupling element includes a flange coupled to the body wall proximate the first end. The coupling element is coupled to the motor housing at the flange proximate the motor drive shaft and the coupling element is disposed over the shaft extension. A mesh element is coupled to the body wall at the exterior. A pump is coupled to the coupling element proximate the second end.

19 Claims, 3 Drawing Sheets

ZERO MAINTENANCE PUMP

BACKGROUND

The present invention relates to pump systems, and more particularly to a zero maintenance pump.

In the dairy industry, high production dairy farms incorporate large numbers of cows in relatively confined feeding and bedding barns. The feeding and bedding barns include concrete flooring configured to drain water by gravity during automatic flush processes. During the flush process, pumps automatically pump high-pressure water over the flooring surfaces to wash waste away and keep the barn clean. The concrete flooring is often wet and covered with organic bedding, feed, twine, manure and urine from the cows. Out of necessity, the barns include hard concrete surfaces that facilitate the flush process as well as efficiently house and feed a maximum number of cows per area. The automated high-pressure water flush systems that wash water over the concrete pathways and flooring in the barns recirculate the water from lagoons to the barns through waste processing devices and return the waste water to the lagoons. The waste water in the lagoons can have suspended debris, such as bailing twine. The bailing twine migrates to the pumps and entangles the pump shaft. The entangled pump shaft reduces pump efficiency and unnecessarily wears the pump. When the pump wears, a portion of the water is driven past the seals and migrates along the pump shaft. The water that migrates along the pump shaft eventually penetrates the motor housing and contaminates the motor housing. The water in the motor housing rapidly degrades the motor and results in major motor failure. The failed motor is very costly to recondition.

What is needed in the art is a waste water pump that is not prone to having the waste water migrating into the motor housing.

SUMMARY

The disclosed device is directed toward a zero maintenance pump including a motor having a motor housing and a motor drive shaft rotatably mounted in the motor housing. A shaft extension is coupled to the motor drive shaft distal from the motor housing. A coupling element has a body with a first end and a second end opposite the first end. The body includes a body wall defining an interior and an exterior. At least one slot is formed in the body wall. The coupling element includes a flange coupled to the body wall proximate the first end. The coupling element is coupled to the motor housing at the flange proximate the motor drive shaft and the coupling element is disposed over the shaft extension. A mesh element is coupled to the body wall at the exterior. The mesh element is configured to prevent debris from entering the interior. A pump is coupled to the coupling element proximate the second end.

Another embodiment is directed toward a zero maintenance pump comprising a motor having a motor housing and a motor drive shaft rotatably mounted in the motor housing. A shaft extension is coupled to the motor drive shaft distal from the motor housing. A coupling element has a body with a first end and a second end opposite the first end. The body includes a body wall defining an interior and an exterior. At least one slot is formed in the body wall. The coupling element includes a flange coupled to the body wall proximate the first end. The coupling element is coupled to the motor housing at the flange proximate the motor drive shaft and the coupling element is disposed over the shaft extension. A first sealing disc is disposed within the interior and is disposed over the shaft extension. A second sealing disc is disposed within the interior and is disposed over the shaft extension, wherein the first sealing disc and the second sealing disc are configured to inhibit fluid travel along the shaft extension. A mesh element is coupled to the body wall at the exterior. The mesh element is configured to prevent debris from entering the interior. A pump is coupled to the coupling element proximate the second end.

A method of using a zero maintenance pump is disclosed. The method comprises mounting the zero maintenance pump near a water source. The zero maintenance pump comprises a motor having a motor housing and a motor drive shaft rotatably mounted in the motor housing. A shaft extension is coupled to the motor drive shaft distal from the motor housing. A coupling element has a body with a first end and a second end opposite the first end. The body includes a body wall defining an interior and an exterior. At least one slot is formed in the body wall. The coupling element includes a flange coupled to the body wall proximate the first end. The coupling element is coupled to the motor housing at the flange proximate the motor drive shaft and the coupling element is disposed over the shaft extension. A first sealing disc is disposed within the interior and is disposed over the shaft extension. A second sealing disc is disposed within the interior and is disposed over the shaft extension, wherein the first sealing disc and the second sealing disc are configured to inhibit fluid travel along the shaft extension. A mesh element is coupled to the body wall at the exterior. The mesh element is configured to prevent debris from entering the interior. A pump is coupled to the coupling element proximate the second end. The method includes submerging the pump below a surface of the water source. The method includes submerging a portion of the coupling element below the surface of the water source. The method includes activating the motor wherein the motor rotates the motor drive shaft and the shaft extension and an impeller of the pump. The method includes inhibiting a flow of debris into the interior of the coupling element. The method includes preventing a flow of water along the shaft extension with the first sealing disc and the second sealing disc. The method includes pumping the water source.

DETAILED DESCRIPTION

Persons of ordinary skill in the art will realize that the following description of the present disclosure is illustrative only and not in any way limiting. Other embodiments of the invention will readily suggest themselves to such skilled persons having the benefit of this disclosure.

An exemplary zero maintenance pump is disclosed. The zero maintenance pump includes a motor having a motor housing and drive shaft rotatably coupled to the motor housing. A shaft extension is coupled to the motor drive shaft and is configured to extend the length of the motor drive shaft. A pump is coupled to the motor housing through a coupling element bolted to the housing proximate the motor drive shaft. The coupling element is disposed over the motor drive shaft and the shaft extension. The coupling element includes a body having a body wall defining an interior and an exterior. The body includes a first end and a second end opposite the first end. The coupling includes a flange coupled to the body wall at the first end. The flange is configured to bolt to the motor housing. At least one slot is formed in the body wall. The slot is configured to facilitate access to the shaft extension and to allow fluid flow between the exterior and the interior. A mesh element is disposed over the exterior of the body. The mesh element is configured to prevent debris from flowing into the interior of the body of the coupling element. The zero maintenance pump operates in a vertical orientation with the motor above the surface of the fluid.

Figure 1:
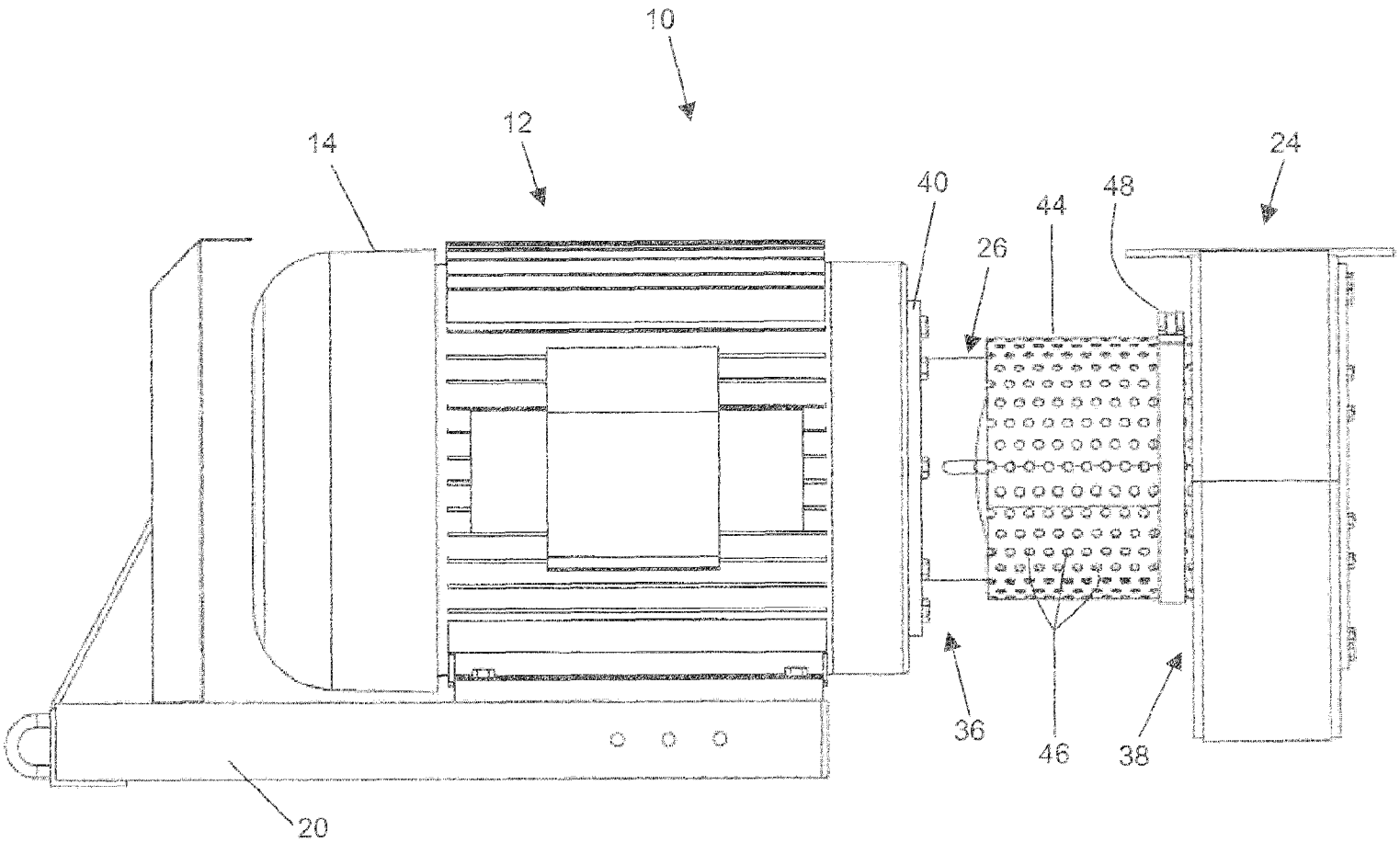
FIG. 1 is a side view of an exemplary pump.
Figure 2:
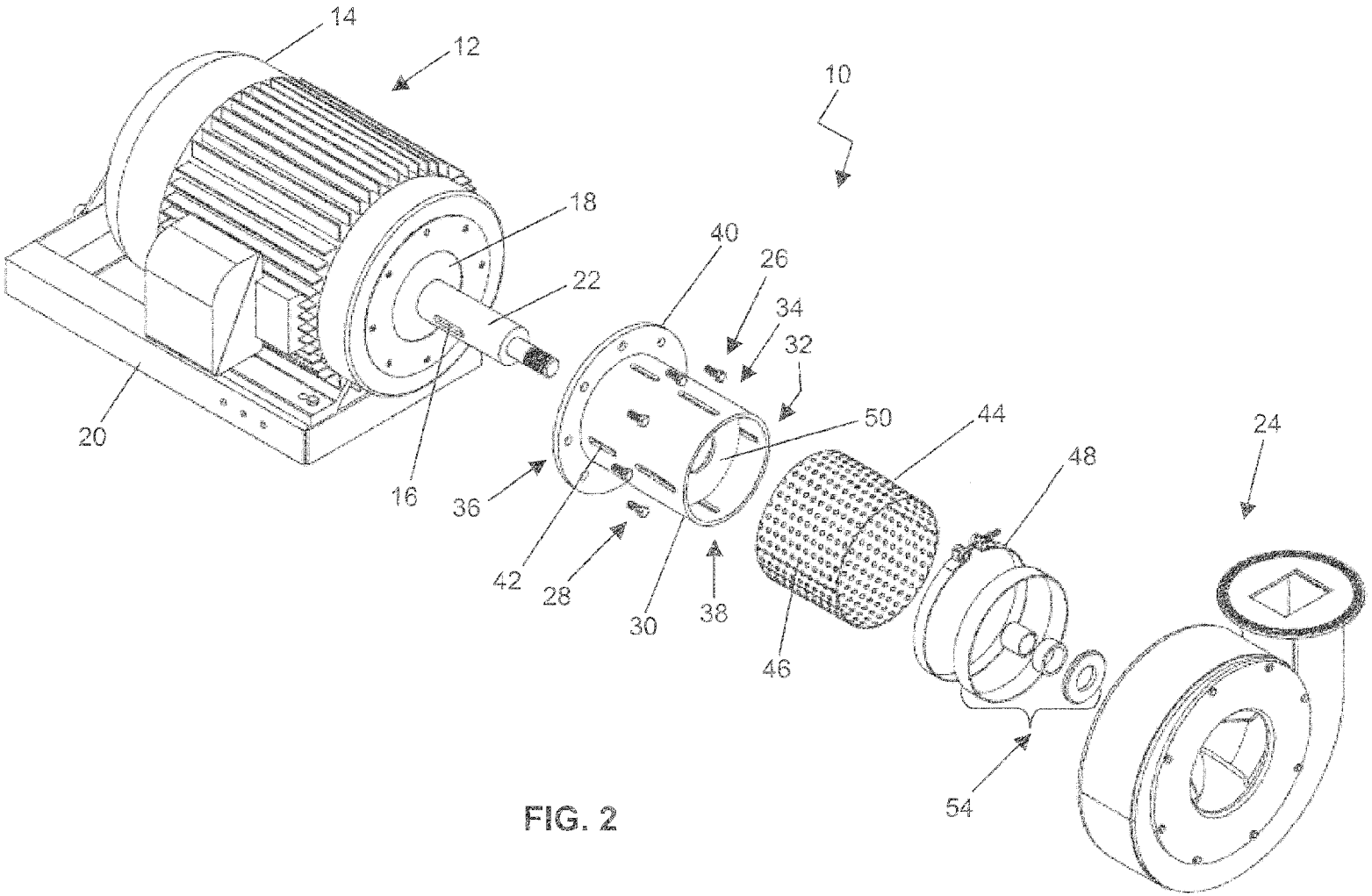
FIG. 2 is an exploded perspective view of an exemplary pump.

Referring now to FIGS. 1 and 2, an exemplary zero maintenance pump 10 is illustrated. The zero maintenance pump 10 includes a motor 12 having a motor housing 14 and motor drive shaft 16 rotatably coupled to the motor housing 14. The motor drive shaft 16 is mounted on motor bearings 18 configured for support of the motor drive shaft in a vertical orientation. In a preferred embodiment, the motor bearings 18 are spherical roller bearings sealed by neoprene seals. The motor 12 can operate at 1200 revolutions per minute (rpm) or 1800 rpm. The motor 12 is mounted to a motor support 20. The motor support 20 is configured to position the zero maintenance pump 10 for operation. A shaft extension 22 is coupled to the motor drive shaft 16 and is configured to extend (i.e., lengthen) the length of the motor drive shaft 16. The shaft extension 22 comprises a threaded female end fitted to couple to the end of the motor drive shaft 16 and a threaded male end fitted to couple to an impeller (not shown).

A pump 24 is coupled to the motor housing 14 through a coupling element 26 bolted to the housing proximate the motor drive shaft 16. The pump 24 is a centrifugal pump having a pump casing and impeller rotatably disposed in the pump casing. The coupling element 26 is disposed over the motor drive shaft 16 and the shaft extension 22. The coupling element 26 includes a body 28 having a body wall 30 defining an interior 32 and an exterior 34. The body 28 includes a first end 36 and a second end 38 opposite the first end 36. The coupling element 26 includes a flange 40 coupled to the body wall 30 at the first end 36. The flange 40 is configured to bolt to the motor housing 14 proximate the motor drive shaft 16 and motor bearings 18. At least one slot 42 is formed in the body wall 30. The slot 42 is configured to facilitate access to the shaft extension 22 and to allow fluid flow between the exterior 34 and the interior 32. The body 28 of the coupling element 26 is shaped substantially as a right circular cylinder. It is contemplated that other shapes can be used.

A mesh element 44 is disposed over the exterior 34 of the body 28. The mesh element 44 is configured to prevent debris from flowing into the interior 32 of the body of the coupling element 26. The mesh element 44 comprises a corrosion resistant material, such as stainless steel, plastic and the like. The mesh element 44 includes a plurality of flow holes 46 configured to allow fluid flow and block debris. An attachment band 48 can couple the mesh element 44 to the coupling element 26. The attachment band 48 can include a hoop shaped band with a threadable fastener for tightening the band around the circumference of the mesh element 44.

Figure 3:
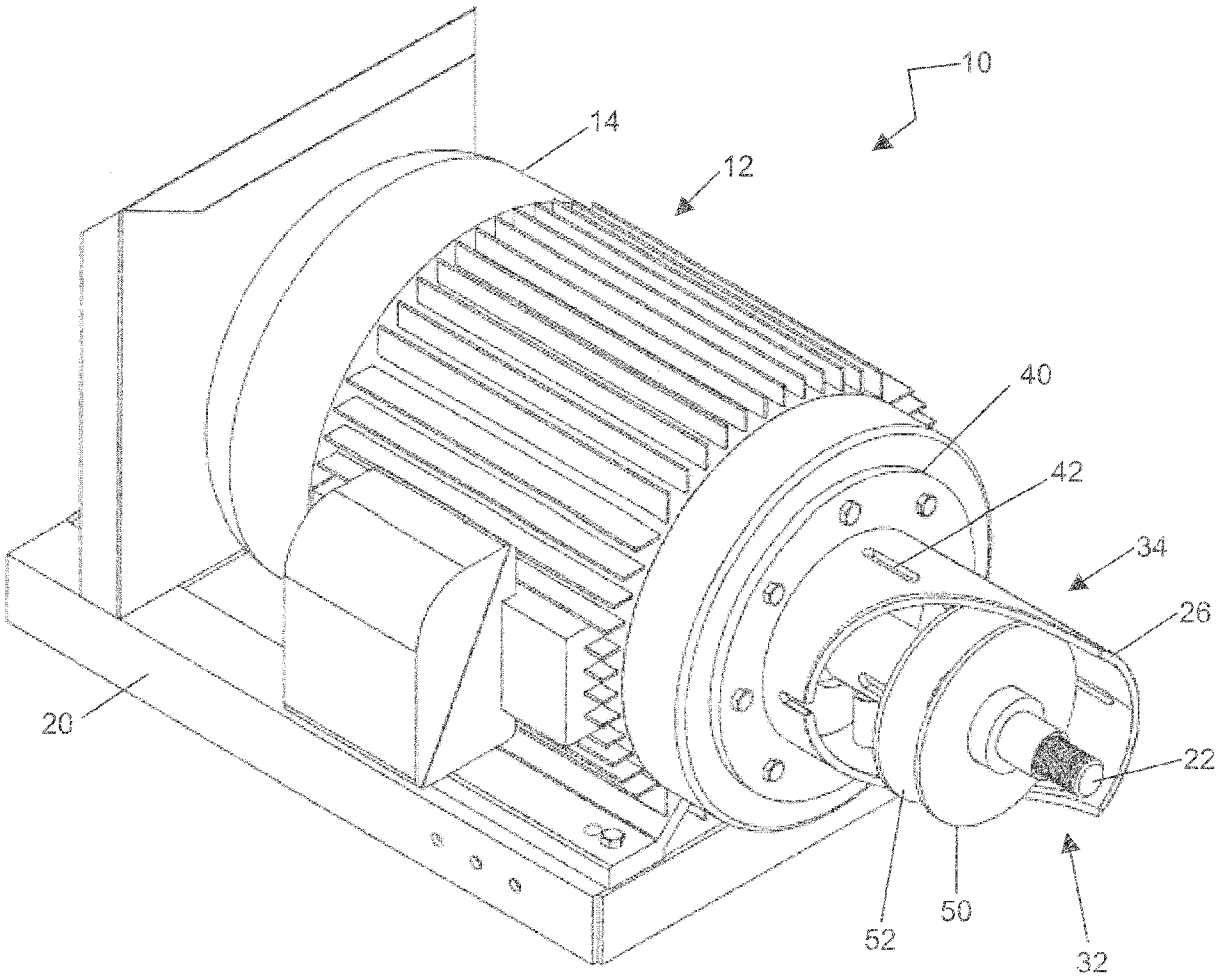
FIG. 3 is a partial cutaway perspective view of an exemplary pump.

At least one sealing disc 50 is disposed over the shaft extension 22 and mounted in the interior 32 to the coupling element 26. The sealing disc (water restrictor disc) 50 is configured to prevent fluid from splashing or flowing upward along the shaft extension 22 into the motor housing 14. In a preferred embodiment, there are two sealing discs 50 and 52, as shown in FIG. 3. The sealing discs 50 and 52 function as a fluid barrier. Fluid is prevented from being drawn up into the motor housing 14. The sealing discs 50 and 52 are closely disposed over the shaft extension 22 and allow the shaft extension 22 to rotate. Pump sealing components (flow restricters) 54 are coupled between the sealing disc 50 and the pump 24.

The zero maintenance pump 10 can be mounted near a water source (not shown). The zero maintenance pump 10 can be submerged, such that the pump 24 is below the surface of the water source. A portion of the coupling element 26 is submerged below the surface of the water source. In a preferred embodiment, the coupling element 26 is submerged about halfway into the water. The motor 12 having been coupled to an electrical power source and controls (not shown) can be activated, wherein the motor 12 rotates the motor drive shaft 16 and the shaft extension 22 and an impeller of the pump 24. Any flow of debris in the water source that may flow toward the interior 32 of the coupling element 26 is prevented by the configuration of the slots 42 and the mesh element 44. Any flow of water along the shaft extension 22 toward the motor housing 14 is inhibited with at least one of the first sealing disc 50 and the second sealing disc 52. The debris is trapped along the mesh element 44 and can be cleaned from the mesh element. In normal operation, a new pump 24 will have properly functioning pump sealing components 54 as well as pump impellers that are not worn. The pump 24 will have low leakage rates out of the pump sealing components 54 up along the shaft extension 22. As the pump 24 is operated over time the pump 24 will wear and components will degrade. The pump 24 will begin to leak greater quantities of water up along the shaft extension 22. The sealing disc 50 will function to deflect and restrict the flow of water along the shaft extension 22 and prevent the water from being forced into the motor housing 14. Thus preventing contamination of the motor 12, functional failure of the motor 12 and subsequent costly repairs.

The zero maintenance pump operates in a vertical orientation with the motor 12 above the surface of the fluid (not shown). The zero maintenance pump 10 can be mounted to a pump mount via the motor support 20. The pump mount (not shown) can be a pontoon float, concrete pad near the water source, and the like. The zero maintenance pump 10 can operate normally at about 1200 revolutions per minute. The zero maintenance pump 10 functions as a low speed pump. In operation, the zero maintenance pump 10 is vertically oriented with the motor 12 out of and above the fluid and the pump 24 submerged. The fluid level can be about halfway along the coupling element 26. The mesh element 44 blocks the entry of debris, such as bailing twine, from fouling the shaft extension 22. The configuration of the coupling element 26 having slots 42 allows for access to the rotating elements within the interior 32 and diminishes the flow of debris into the interior 32. The sealing disc 50 further diminishes the fluid flow up along the shaft extension 22 toward the motor housing 14. With the configuration of the zero maintenance pump 10 long hours of operation can be obtained without the need to shut down and clean, or remove the debris that can foul the prior art pump. The zero maintenance pump 10 is well suited for use in dairy farm flush systems as well as other service in water having debris.

While embodiments and applications of this disclosure have been shown and described, it would be apparent to those skilled in the art that many more modifications than mentioned above are possible without departing from the inventive concepts herein. The disclosure, therefore, is not to be restricted except in the spirit of the appended claims.

What is claimed is:

1. A zero maintenance pump comprising:

a motor having a motor housing and a motor drive shaft rotatably mounted in the motor housing;

a shaft extension coupled to said motor drive shaft distal from said motor housing;

a coupling element having a body with a first end and a second end opposite said first end, said body including a body wall defining an interior and an exterior, at least one slot is formed in said body wall, said coupling element including a flange coupled to said body wall proximate said first end, said coupling element being coupled to said motor housing at said flange proximate said motor drive shaft and said coupling element being disposed over said shaft extension;

at least one sealing disc within said interior coupled to said coupling element and disposed over said shaft extension;

a mesh element coupled to said body wall at said exterior, said mesh element configured to prevent debris from entering said interior; and a pump coupled to said coupling element proximate said second end.

2. The zero maintenance pump of claim 1 wherein said at least one sealing disc is configured to inhibit water from entering said motor housing.

3. The zero maintenance pump of claim 2 wherein said at least one sealing disc is configured to inhibit fluid travel along said shaft extension past said at least one sealing disc.

4. The zero maintenance pump of claim 1 further comprising:

a first sealing disc within said interior and disposed over said shaft extension and a second sealing disc within said interior and disposed over said shaft extension, wherein said first and said second sealing disc are configured to inhibit fluid travel along said shaft extension.

5. The zero maintenance pump of claim 1 wherein said slot in said body wall is configured to allow manual access to said interior.

6. The zero maintenance pump of claim 1 wherein the zero maintenance pump is configured for vertical operation, wherein said motor is oriented above said pump out of a fluid and said pump is submergible in said fluid.

7. The zero maintenance pump of claim 1 wherein said mesh element comprises a stainless steel expanded metal sheet formed into a right circular cylinder shape.

8. The zero maintenance pump of claim 1 wherein said mesh element is coupled to said coupling element with an attachment band.

9. The zero maintenance pump of claim 1 wherein said pump is a centrifugal pump.

10. A zero maintenance pump comprising:

a motor having a motor housing and a motor drive shaft rotatably mounted in the motor housing;

a shaft extension coupled to said motor drive shaft distal from said motor housing;

a coupling element having a body with a first end and a second end opposite said first end, said body including a body wall defining an interior and an exterior, at least one slot is formed in said body wall, said coupling element including a flange coupled to said body wall proximate said first end, said coupling element being coupled to said motor housing at said flange proximate said motor drive shaft and said coupling element being disposed over said shaft extension;

a first sealing disc disposed within said interior and disposed over said shaft extension and a second sealing disc disposed within said interior and disposed over said shaft extension, wherein said first sealing disc and said second sealing disc are configured to inhibit fluid travel along said shaft extension;

a mesh element coupled to said body wall at said exterior, said mesh element configured to prevent debris from entering said interior; and a pump coupled to said coupling element proximate said second end.

11. The zero maintenance pump of claim 10 wherein the zero maintenance pump is configured for vertical operation, wherein said motor is oriented above said pump out of a fluid and said pump is submergible in said fluid.

12. The zero maintenance pump of claim 10 wherein said mesh element comprises a corrosion resistant material having a plurality of flow holes, said material being formed into a right circular cylinder shape.

13. The zero maintenance pump of claim 10 wherein said mesh element is configured to allow fluid flow and inhibit the flow of debris into said interior proximate said shaft extension.

14. The zero maintenance pump of claim 10 wherein said motor drive shaft is supported by motor bearings.

15. The zero maintenance pump of claim 10 wherein said coupling element is configured in substantially a right circular cylinder.

16. A method of using a zero maintenance pump comprising:

mounting the zero maintenance pump near a water source, the zero maintenance pump comprising a motor having a motor housing and a motor drive shaft rotatably mounted in the motor housing, a shaft extension coupled to said motor drive shaft distal from said motor housing, a coupling element having a body with a first end and a second end opposite said first end, said body including a body wall defining an interior and an exterior, at least one slot is formed in said body wall, said coupling element including a flange coupled to said body wall proximate said first end, said coupling element being coupled to said motor housing at said flange proximate said motor drive shaft and said coupling element being disposed over said shaft extension, a first sealing disc within said interior and disposed over said shaft extension and a second sealing disc within said interior and disposed over said shaft extension, wherein said first sealing disc and said second sealing disc are configured to inhibit fluid travel along said shaft extension, a mesh element coupled to said body wall at said exterior, said mesh element configured to prevent debris from entering said interior; and a pump coupled to said coupling element proximate said second end;

submerging said pump below a surface of the water source;

submerging a portion of said coupling element below said surface of said water source;

activating said motor wherein said motor rotates said motor drive shaft and said shaft extension and an impeller of said pump;

inhibiting a flow of debris into said interior of said coupling element;

preventing a flow of water along said shaft extension with said first sealing disc and said second sealing disc; and pumping said water source.

17. The method of claim 16 further comprising:

cleaning said debris from said mesh element.

18. The method of claim 16 further comprising:

operating the zero maintenance pump at a rotational speed of 1200 revolutions per minute.

19. The method of claim 16 wherein said mounting of the zero maintenance pump includes substantially vertical orientation of said motor and pump in said water source.

* * * * *